US012207783B2

(12) United States Patent
Lee et al.

(10) Patent No.: US 12,207,783 B2
(45) Date of Patent: Jan. 28, 2025

(54) CLEANER

(71) Applicant: LG ELECTRONICS INC., Seoul (KR)

(72) Inventors: Sangkyu Lee, Seoul (KR); Inbo Shim, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 214 days.

(21) Appl. No.: 17/738,601

(22) Filed: May 6, 2022

(65) Prior Publication Data

US 2022/0257072 A1 Aug. 18, 2022

Related U.S. Application Data

(62) Division of application No. 17/369,264, filed on Jul. 7, 2021, which is a division of application No. 15/855,969, filed on Dec. 27, 2017, now abandoned.

(30) Foreign Application Priority Data

Dec. 30, 2016 (KR) ..... 10-2016-0184449

(51) Int. Cl.
*A47L 9/04* (2006.01)
*A46B 1/00* (2006.01)
(Continued)

(52) U.S. Cl.
CPC ..... *A47L 9/0488* (2013.01); *A46B 1/00* (2013.01); *A46B 13/001* (2013.01);
(Continued)

(58) Field of Classification Search
CPC ..... A46B 7/042; A46B 13/005; A46B 3/16; A46B 9/06; A47L 9/0477; A47L 9/0466; A47L 5/30
(Continued)

(56) References Cited

U.S. PATENT DOCUMENTS 1,886,129 A 11/1932 Smellie
2,754,531 A * 7/1956 Rowland ..... A46B 13/005 15/183
(Continued)

FOREIGN PATENT DOCUMENTS

CN 102342797 2/2012
DE 2020976 A1 * 11/1970 ..... A46B 3/08
(Continued)

OTHER PUBLICATIONS

Korean Office Action dated Jan. 22, 2018 issued in Application No. 10-2016-0184449.
(Continued)

*Primary Examiner* — Bryan R Muller
(74) *Attorney, Agent, or Firm* — KED & ASSOCIATES, LLP

(57) ABSTRACT

A cleaner includes a cleaner main body, and a suction unit connected to the cleaner main body to suck air containing dust, and provided with a brush assembly brought into contact with a floor, wherein the brush assembly includes a rotating rod rotatable in one direction, a brush portion protruding from an outer circumferential surface of the rotating rod to rotate together with the rotating rod, and a blade erected at the rear of the brush portion in the one direction to be adjacent to the brush portion, and brought into contact with the brush portion during the rotation in the one direction, to prevent foreign substances from getting tangled in the brush portion. This configuration may prevent foreign substances such as hair and the like from being tangled in the brush portion during an operation of the cleaner.

21 Claims, 8 Drawing Sheets

(51) Int. Cl.
*A46B 13/00* (2006.01)
*A47L 7/00* (2006.01)

(52) U.S. Cl.
CPC ..... *A46B 13/005* (2013.01); *A47L 7/0066* (2013.01); *A47L 9/0477* (2013.01); *A47L 2201/00* (2013.01)

(58) Field of Classification Search
USPC ..... 15/366, 183
See application file for complete search history.

(56) References Cited

U.S. PATENT DOCUMENTS

| | | | | |
|---|---|---|---|---|
| 3,225,374 | A | 12/1965 | Daley et al. | |
| 3,241,172 | A | 3/1966 | Tilgner | |
| 7,140,062 | B1 * | 11/2006 | Chen | A47L 9/04 15/179 |
| 10,092,153 | B2 * | 10/2018 | Shim | A47L 9/0477 |
| 2010/0037418 | A1 | 2/2010 | Hussey et al. | |
| 2010/0306959 | A1 * | 12/2010 | Follows | A46B 13/005 15/88.4 |
| 2015/0342430 | A1 | 12/2015 | Kasper et al. | |
| 2016/0047135 | A1 | 2/2016 | Klebanov et al. | |
| 2016/0278595 | A1 | 9/2016 | Shim et al. | |
| 2018/0070785 | A1 | 3/2018 | Udy et al. | |
| 2019/0290085 | A1 | 9/2019 | Park et al. | |
| 2021/0045519 | A1 | 2/2021 | Chen | |

FOREIGN PATENT DOCUMENTS

| | | | | | |
|---|---|---|---|---|---|
| FR | 1026269 | | | 4/1953 | |
| GB | 389743 | | | 3/1933 | |
| GB | 2443364 | | | 4/2008 | |
| JP | H05-088467 | U | | 12/1993 | |
| JP | H07-059689 | | | 3/1995 | |
| JP | H-0759689 | | | 3/1995 | |
| JP | H-0759689 | A | * | 3/1995 | A47L 9/04 |
| JP | 2003-052584 | | | 2/2003 | |
| JP | 2005-013319 | | | 1/2005 | |
| JP | 2011-005339 | | | 1/2011 | |
| JP | 2012-090984 | | | 5/2012 | |
| KR | 10-2011-0125942 | | | 11/2011 | |
| KR | 10-1248766 | | | 4/2013 | |
| KR | 10-1644887 | | | 8/2016 | |

OTHER PUBLICATIONS

International Search Report and Written Opinion dated Mar. 15, 2018 issued in Application No. PCT/KR2017/014092.
Korean Notice of Allowance dated Jul. 31, 2018 issued in Application No. 10-2016-0184449.
European Search Report dated Aug. 6, 2020 issued in EP Application No. 17888511.7.
European Search Report dated Jan. 14, 2021 issued in EP Application No. 17888511.7.
U.S. Office Action dated Feb. 23, 2024 issued in U.S. Appl. No. 17/369,264.

* cited by examiner

CLEANER

CROSS-REFERENCE TO RELATED APPLICATIONS

This application is a Divisional Application of U.S. patent application Ser. No. 17/369,264, filed Jul. 7, 2021, which is a Divisional Application of U.S. patent application Ser. No. 15/855,969 filed Dec. 27, 2017, which claims priority under 35 U.S.C. § 119 to Korean Application No. 10-2016-0184449, filed on Dec. 30, 2016, whose entire disclosures are hereby incorporated by reference.

1. FIELD OF THE INVENTION

The present invention relates to a cleaner for removing dust on a floor by using a suction flow.

2. BACKGROUND OF THE INVENTION

Generally, a cleaner includes a vacuum cleaner in which a fan is rotated by a driving motor to generate a suction flow so as to suck dust. In recent years, as an application field of robots has expanded, a robot cleaner has been produced which is configured to autonomously travel within a predetermined space to suck dust on a floor or mop the floor.

A cleaner which is operated by a user's manipulation or autonomously travels is provided with a brush assembly for effectively sucking dust on a floor (surface). Specifically, the brush assembly is rotated by a separate driving motor or the like, or rotated by rolling friction with the floor. Further, the brush assembly is provided with a brush having a plurality of bristles on an outer circumference of a rotating body, and the brush sweeps dust on a bottom surface (floor) toward a suction port to induce the suction of the dust.

Cleanness of the brush assembly is important because the brush assembly is in direct contact with a space to be cleaned, and foreign materials remain in the brush even after the operation of the cleaner. Particularly, a case where hair or the like gets tangled between the bristles constituting the brush becomes a major problem.

Patent Document 1 as the related art discloses a structure including a blade in order to solve the problem that hair or the like gets tangled into the brush assembly and is not easily removed. However, the related art structure is similar to a structure for facilitating a removal of hair that has already become tangled in the brush. That is, there has been a limit in preventing or limiting hair from getting tangled during the operation of the cleaner.

In addition, there are various difficulties in a process of fabricating a brush assembly having a rotating body which includes a brush and a blade. Typically, as disclosed in Patent Document 1, there is a problem that a method of directly planting a large number of bristles in a circular rotating body requires a long fabricating time and lots of fabricating costs. In addition, there is a limit in densely constructing a space between bristles, which is likely to deteriorate cleaning performance.

As another method, there is a method of coupling a brush component, which is produced through a separate process of densely planting bristles, to a rotating body in a screw coupling manner. However, as the brush and the blade are constructed variously, assembly convenience is lowered.

Accordingly, there is a need of developing a brush assembly which has a structure of preventing foreign materials such as hair and the like from being introduced (tangled) into a brush and is easy to be fabricated and assembled.

(Patent Document 1) KR10-2011-0125942 A (Nov. 22, 2011)

DETAILED DESCRIPTION OF THE PREFERRED EMBODIMENT

Figure 1:
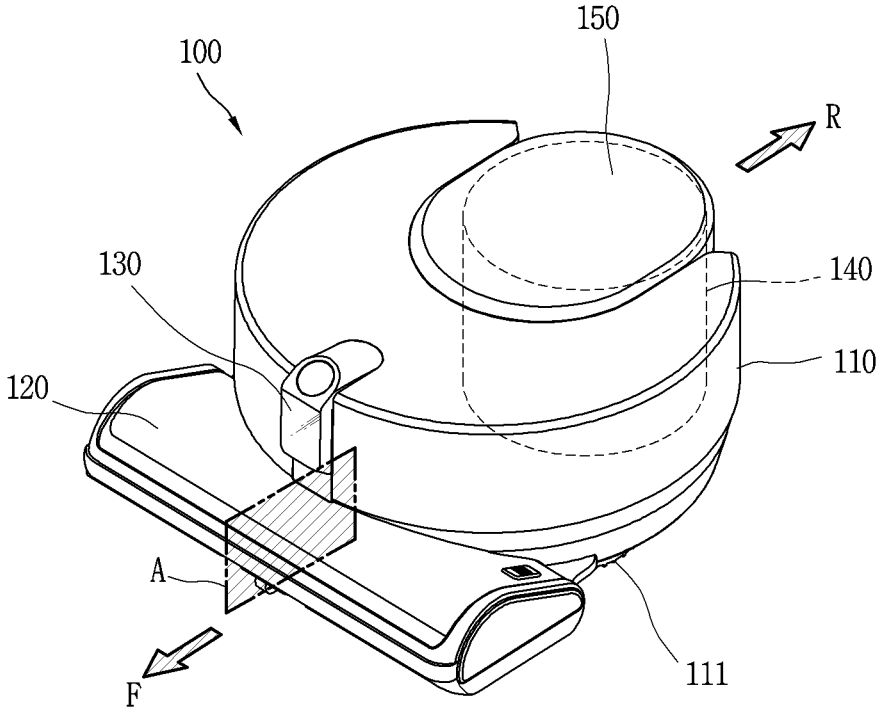
FIG. 1 is a perspective view illustrating one embodiment of a cleaner according to the present invention.

A first aspect of the present invention is to provide a cleaner having a brush assembly, in which foreign substances including hair can be prevented from being introduced and remaining in a brush portion.

A second aspect of the present invention is to provide a cleaner having a brush assembly having a brush portion which can be easily fabricated in various shapes and dense arrangement.

A third aspect of the present invention is to provide a cleaner, in which components of a brush assembly can be easily assembled with each other.

In order to achieve the first aspect of the present invention, a cleaner according to the present invention may include a cleaner main body, and a suction unit connected to the cleaner main body to suck air containing dust, and provided with a brush assembly brought into contact with a floor. The brush assembly may include a rotating rod rotatable in one direction, a brush portion protruding from an outer circumferential surface of the rotating rod to rotate together with the rotating rod, and a blade erected at the rear of the brush portion in the one direction to be adjacent to the brush portion and brought into contact with the brush portion during the rotation in the one direction, to prevent foreign substances from getting tangled in the brush portion.

In detail, the brush portion may include a plurality of bristles each disposed in a radial direction of the rotating rod along a preset path from one end to another end of the rotating rod, and the blade may protrude in the radial direction from the outer circumferential surface of the rotating rod and extend along the preset path.

At this time, the blade may be made of an elastic material, specifically, a material having a smaller elastic modulus than the brush portion.

In addition, the brush portion and the blade may be formed to have the same height from the outer circumferential surface of the rotating rod.

The brush assembly may further include a support member erected at the rear of the blade in the one direction to be adjacent to the blade, so as to support the blade during the rotation in the one direction.

In addition, the support member, similar to the brush portion, may be provided with a plurality of bristles each disposed in the radial direction of the rotating rod.

Alternatively, the support member may be made of an elastic material, specifically, a material having a higher elastic modulus than the blade.

The brush portion, the blade and the support member may protrude by the same height from the outer circumferential surface of the rotating rod.

To achieve the second aspect of the present invention, a cleaner according to the present invention may a cleaner main body, and a suction unit connected to the cleaner main body to suck air containing dust, and provided with a brush assembly brought into contact with a floor. The brush assembly may include a rotating rod rotatable in one direction, a plurality of covers mounted on an outer circumferential surface of the rotating rod and spaced apart from one another in a circumferential direction of the rotating rod to form brush slits, and brush units insertable into the respective brush slits from an end portion of the rotating rod so as to be rotated together with the rotating rod.

In this instance, each of the brush units may include a base portion extending along the brush slit and formed to be inserted between an inner circumferential surface of the cover and an outer circumferential surface of the rotating rod, and a brush portion mounted on the base portion, and provided with a plurality of bristles arranged in the radial direction of the rotating rod along the brush slit.

The brush unit may further include a blade erected at the rear of the brush portion in the one direction to be adjacent to the brush portion, so as to be brought into contact with the brush portion during the rotation in the one direction.

The brush unit may further include a support member erected adjacent to the rear of the blade in the one direction so as to support the blade during the rotation in the one direction.

The support member may extend to cover an end portion of the blade at a side of the rotating rod so as to be integrally formed with the brush portion.

To achieve a third aspect of the present invention, a cleaner according to the present invention may include a cleaner main body, and a suction unit connected to the cleaner main body to suck dust, and provided with a brush assembly brought into contact with a floor. The brush assembly may include a rotating rod rotatable in one direction, a plurality of covers mounted on an outer circumferential surface of the rotating rod, and arranged with being spaced apart from one another in a circumferential direction of the rotating rod so as to form brush slits, and brush units insertable into the respective brush slits from an end portion of the rotating rod, so as to be rotated together with the rotating rod. The cover may be provided with a hook portion protruding toward the rotating rod, and the rotating rod may be provided with a hook receiving portion formed on the outer circumferential surface of the rotating rod such that the hook portion is locked and accommodated therein.

In addition, the brush assembly may further include an end cover coupled to the end portion of the rotating rod to support the brush units in an axial direction of the rotating rod.

In this instance, the brush assembly may further include a connection pin elastically supported inside the rotating rod and protruding in the axial direction through a through hole formed through the end cover.

Meanwhile, the brush slit may extend from one end to another end of the rotating rod into a shape of being bent at least once, and the brush unit may be made of an elastic material so as to be inserted into the brush slit in a bent manner.

According to the present invention constituted by the solution described above, the following effects can be obtained.

First, a brush assembly of a cleaner according to the present invention may be provided with blades rotated with being brought into contact with brush portions, to block foreign substances such as hair, thereby preventing the foreign substances from being caught and remaining in the brush portions.

The blade may be made of an elastic material, in particular, a material having a smaller elastic modulus than that of the brush portion, so as not to interfere with an operation of the brush portion of elastically sweeping a floor.

On the other hand, the brush portion and the blade may have the same height, thereby preventing noise generation that the blade hits the floor during the rotation, and preventing hair from being caught in the brush portion.

Further, by further providing a support member at the rear of the blade, the blade can be prevented from being lowered in height due to being bent. This may result in more effectively realizing the prevention of introduction of hair.

The support member may be provided with bristles, like the brush portion, so as to be easily fabricated without an addition of a separate member or process.

Since the brush portion, the blade, and the support member have the same height, and the support member and the brush portion are made of the same material, introduction and remaining of hair can be prevented even if the rotating rod is bi-directionally rotated.

Second, the brush assembly of the cleaner according to the present invention may be constructed by assembling a rotating rod, covers and brush units, which may facilitate a plurality of brush units to be fabricated in various shapes.

Particularly, since a brush unit having a base portion and a brush portion can be separately fabricated, time and costs required for fabricating the bristles of the brush portion at dense intervals can be reduced.

The brush portion and the support member may be integrally formed to cover the blade, which may result in more easily fabricating the brush portion having the dense bristle interval, the blade and the support member.

Third, the brush assembly of the cleaner according to the present invention may be assembled by coupling the rotating rod and the covers in a hook coupling manner, which may facilitate the assembly of added components.

Further, an end cover for supporting the brush units mounted in an inserting manner may be provided, to enable sealing and firm engagement of the brush assembly.

At this time, the brush assembly may further include a connection pin which is elastically supported, and the connection pin may be locked in the end cover, thereby facilitating an addition of a detachable structure of the brush assembly.

Furthermore, since the brush unit is made of an elastic material, it can be easily inserted into a bent path formed by a plurality of covers, and formed in various shapes.

Hereinafter, a cleaner according to the present invention will be described in detail with reference to the accompanying drawings.

The same or equivalent components may be provided with the same or similar reference numbers, even in different embodiments, and description thereof will not be repeated.

In describing the present invention, if a detailed explanation for a related known function or construction is considered to unnecessarily divert the gist of the present disclosure, such explanation has been omitted but would be understood by those skilled in the art.

The accompanying drawings are used to help easily understand the technical idea of the present invention and it should be understood that the idea of the present invention is not limited by the accompanying drawings. The idea of the present invention should be construed to extend to any alterations, equivalents and substitutes besides the accompanying drawings.

A singular representation may include a plural representation unless it represents a definitely different meaning from the context.

Figure 2:
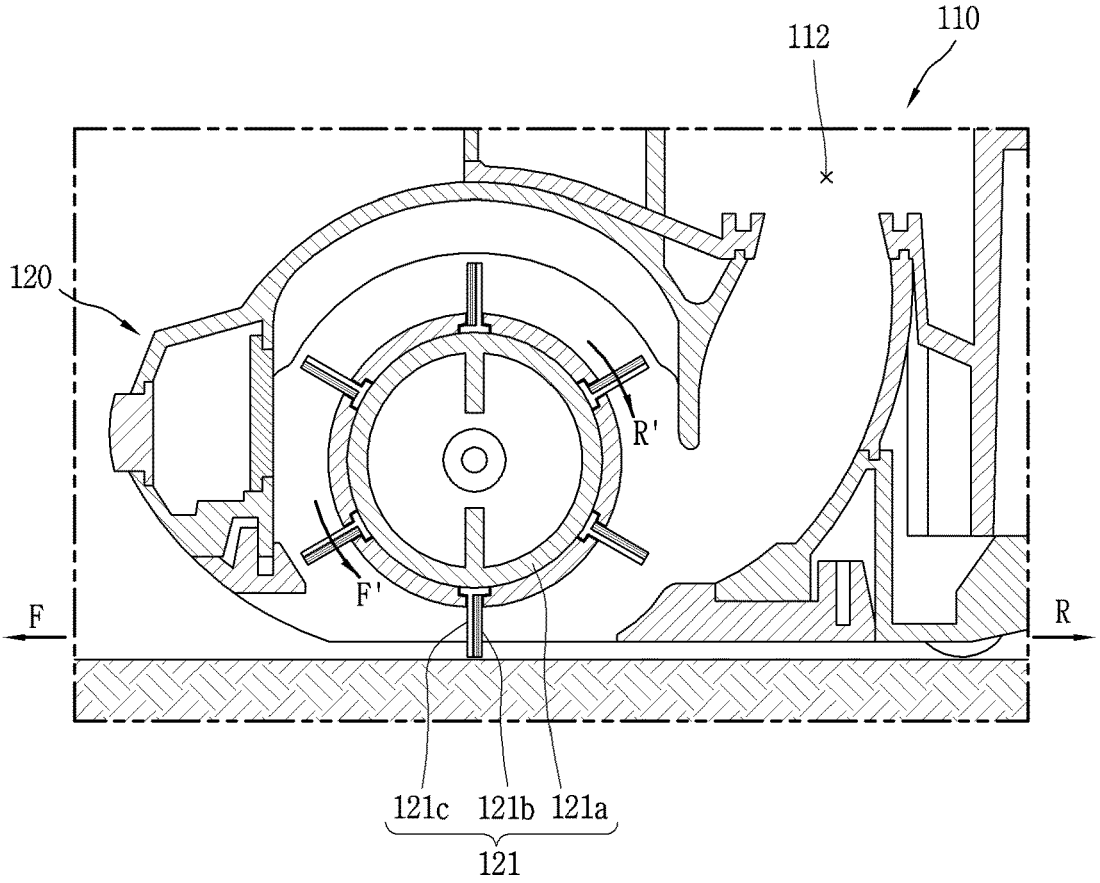
FIG. 2 is a sectional view of an area A illustrated in FIG. 1.

FIG. 1 is a perspective view illustrating one example of a cleaner 100 according to the present invention, and FIG. 2 is a sectional view of an area A illustrated in FIG. 1. As illustrated in FIGS. 1 and 2, a cleaner 100 according to the present invention includes a cleaner main body 110 and a suction unit 120.

The cleaner main body 110 defines appearance of the cleaner 100. As illustrated in FIG. 1, the cleaner 100 according to the present invention may be a robot cleaner that performs a function of cleaning a floor while traveling on a predetermined area by itself. At this time, cleaning the floor includes sucking foreign substances such as dust present on the floor or mopping the floor.

In the embodiment of the robot cleaner, the cleaner main body 110 may include a wheel unit 111 for traveling, and a controller (not illustrated) for controlling an operation of the wheel unit 111. In addition, the cleaner main body 110 may include a battery (not illustrated) for supplying power, and the battery may be detachably mounted on a bottom surface of the cleaner main body 110, for example.

The suction unit 120 is connected to the cleaner main body 110 and serves to suck air containing dust. As illustrated in FIGS. 1 and 2, the suction unit 120 may be disposed in a shape protruding from one side of the cleaner main body 110. The one side where the suction unit 120 protrudes may be a front side (F) to which the cleaner of the present invention travels. In addition, the suction unit 120, as illustrated in FIG. 1, may have a shape protruding to both of right and left sides.

The cleaner 100 according to the present invention may further include a sensing unit 130. As illustrated in FIG. 1, the sensing unit 130 may be disposed to face the front side F of the cleaner main body 110 where the suction unit 120 is located. More specifically, the sensing unit 130 may be disposed on an upper side of the suction unit 120, and detect features to prevent the suction unit 120 located at the foremost side F of the cleaner 100 from bumping into an obstacle or the like.

Meanwhile, a dust container 140 may be detachably coupled to the cleaner main body 110. In this embodiment, the dust container 140 may be located on a rear side R as another side of the cleaner main body 110, or may be formed to protrude toward the rear side R of the cleaner main body 110. In addition, when the dust container 140 is mounted on the cleaner main body 110, the dust container 140 may be covered with a dust container cover 150.

According to the connection relation between the suction unit 120 and the dust container 140, air containing dust, which is introduced through the suction unit 120, may be guided into the dust container 140 along an intake flow path 112 within the cleaner main body 110. The dust is separated from the air while passing through a filter or cyclone of the dust container 140, and collected in the dust container 140. The separated dust is discharged from the dust container 140, and finally exhausted to outside through an exhaust port via an exhaust flow path within the cleaner main body 110.

The foregoing description has been given of overall components of the cleaner 100 of the present invention. Hereinafter, a brush assembly 121 provided in the suction unit 120 of the cleaner 100 according to the present invention will be described in detail.

The suction unit 120 of the cleaner 100 according to the present invention includes a brush assembly 121 for effectively sucking dust and foreign substances present on a floor. The brush assembly 121 is brought into contact with the floor as a space to be cleaned, and serves to help a smooth introduction of foreign substances into the suction unit 120. As illustrated in FIG. 2, the brush assembly 121 may be accommodated within the suction unit 120, and specifically, may be detachably accommodated so as to be managed by a user in a clean condition.

In case of a general vacuum cleaner, the brush assembly 121 may be rotated by rolling friction with the floor according to a user's manipulation. In case of the robot cleaner, the brush assembly 121 may be automatically rotated by a separate driving motor. Hereinafter, the brush assembly 121 will be described on the basis of an example of the robot cleaner illustrated in FIGS. 1 and 2.

Figure 3:
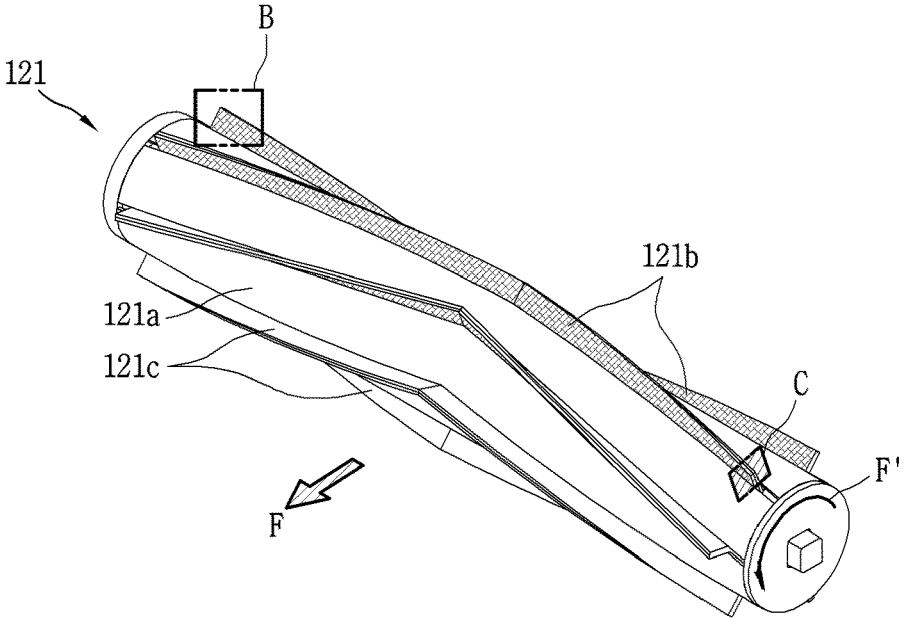
FIG. 3 is a perspective view illustrating a brush assembly in accordance with one embodiment of the present invention.
Figure 4A:
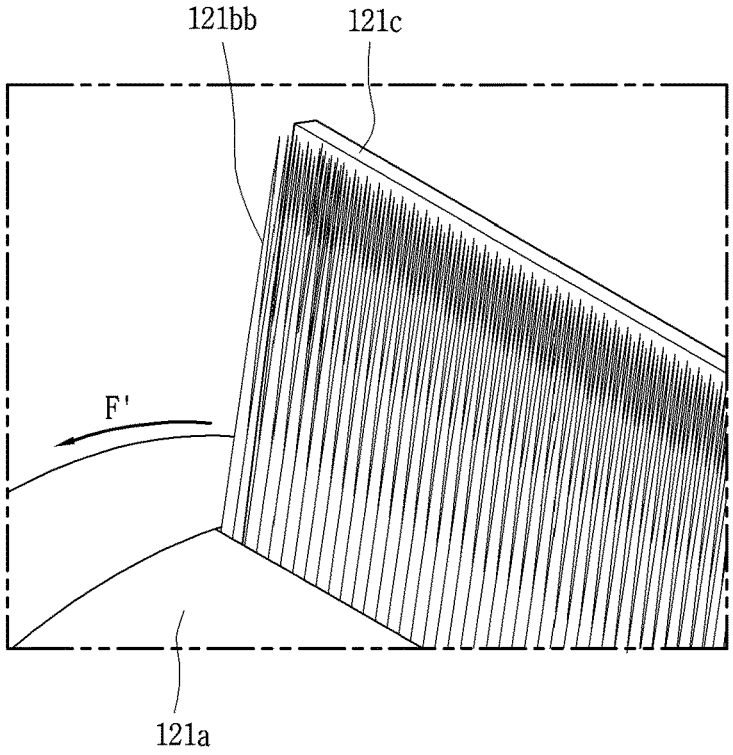
FIG. 4A is an enlarged view of an area B illustrated in FIG. 3.
Figure 4B:
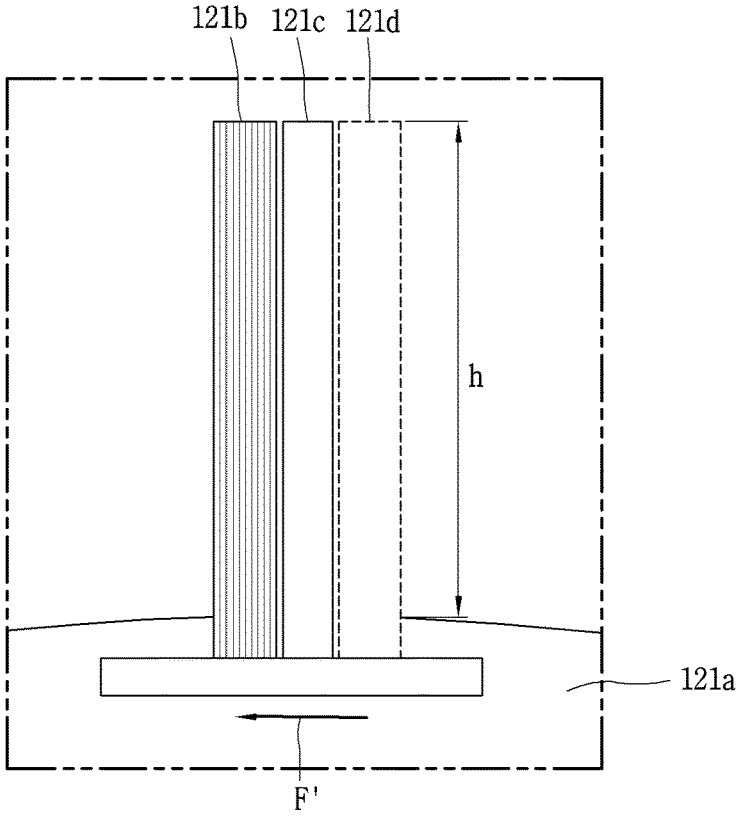
FIG. 4B is a sectional conceptual view illustrating an area C illustrated in FIG. 3.

FIG. 3 is a perspective view illustrating the brush assembly 121 according to one embodiment of the present invention. Also, FIG. 4A is an enlarged view of an area B illustrated in FIG. 3, and FIG. 4B is a schematic sectional view of an area C illustrated in FIG. 3. Hereinafter, description will be given of one embodiment in which foreign substances such as hair and the like are prevented from remaining with being tangled in the brush assembly 121.

The brush assembly 121 according to one embodiment of the present invention includes a rotating rod 121*a*, brush portions 121*b*, and blades 121*c*.

The rotating rod 121*a* is a component that plays a role of supporting and rotating the brush portions 121*b* to be described later. The rotating rod 121*a* may be configured to be detachably coupled to the suction unit 120 so that the user can manage the brush assembly 121 in a clean state. The rotating rod 121*a* may be formed in a cylindrical shape extending long in left and right directions with respect to the front side F to which the cleaner is moved. The rotating rod 121*a* may be rotatably supported by the suction unit 120 at both left and right end portions thereof.

The brush portions 121*b* function to sweep foreign substances such as dust and the like on the floor and help the foreign substances to be sucked into the cleaner. Each of the brush portions 121*b* may be provided with a plurality of bristles 121*bb* protruding from an outer circumferential surface of the rotating rod 121*a* and disposed in a radial direction of the rotating rod 121*a*. The brush portions 121*b* may be configured to extend to both left and right sides together with the rotating rod 121*a*. In particular, as illustrated in FIG. 3, the brush portions 121*b* may be disposed along a preset path where a plurality of spirals are connected along the outer circumferential surface of the rotating rod 121*a*.

On the other hand, each of the blades 121*c* is a component for preventing thin and long foreign substances such as hair and the like from being caught (tangled) in the brush portion 121*b*. The blade 121*c* may be erected adjacent to a rear side R' of the brush portion 121*b* on the rotating rod 121*a* when a rotating direction of the rotating rod 121*a* is assumed as a front side F'. The blade 121*c* may uprightly protrude from the outer circumferential surface of the rotating rod 121*a* and extend to both right and left ends of the rotating rod 121*a* along a preset path of the brush portion 121*b*.

Particularly, the blade 121*c*, as illustrated in FIG. 4B, is disposed adjacent to the brush portion 121*b*. In some cases, the blade 121*c* may be arranged to be in close contact with the brush portion 121*b*, or may be disposed with being spaced apart from the brush portion 121*b* at a preset interval.

However, the blade 121*c* of the present invention is brought into contact with the brush portion 121*b* at least when the rotating rod 121*a* is rotated. Specifically, as the brush portion 121*b* having elasticity is pressed by the floor at the front side F' of the rotating direction, the brush portion 121*b* may be brought into contact with the blade 121*c* at the rear side R'.

Hereinafter, an effect that the blade 121*c* can prevent or extremely limit hair and the like from being tangled will be described with reference to FIGS. 4A and 4B.

Long and thin foreign substances such as hair and the like may be tangled in the plurality of bristles 121*bb* and the tangled foreign substances may not be easily removed merely by suction force of the suction unit 120. As illustrated in FIG. 4A, when each blade 121*c* is formed to substantially cross the rotating rod 121*a* in an axial direction of the rotating rod 121*a*, the hair is caught by the blade 121*c* so as to be prevented from being tangled in the plurality of bristles 121*bb* constituting the brush portion 121*b*. Particularly, as illustrated in FIG. 4B, when the blade 121*c* is positioned so as to be closely adhered to or as close as possible to the rear side R' of the brush portion 121*b*, it is also possible to prevent the hair from being caught in an upper end portion of the brush portion 121*b*.

In the meantime, the blade 121*c* may be made of an elastic material, like the brush portion 121*b*, and may be made of a thin rubber film, for example. Particularly, the blade 121*c* may be made of a material having a smaller elastic modulus than the brush portion 121*b*. Thus, the blade 121*c* can prevent the introduction of foreign substances without interfering with the operation of the brush portion 121*b* of elastically sweeping the floor.

Also, as illustrated in FIG. 4B, the brush portion 121*b* and the blade 121*c* may have the same height h in a radial direction of the rotating rod 121*a*. That is, the brush portion 121*b* and the blade 121*c* may protrude from the outer circumferential surface of the rotating rod 121*a* by the same height.

When the blade 121*c* has a lower height than the brush portion 121*b*, hair may be caught and remain in the bristles 121*bb* of the upper end portion of the brush portion 121*b*, which are higher than the blade 121*c* in height, even if the blade 121*c* is closely adhered to the rear side of the brush portion 121*b*. Conversely, when the blade 121*c* protrudes higher than the brush portion 121*b*, the blade 121*c* may hit the floor to cause noise and damage during rotation of the brush assembly 121. Therefore, when the blade 121*c* is formed at the same height as the brush portion 121*b*, the hair introduction can be more effectively prevented.

Meanwhile, as illustrated in FIG. 4B, the brush assembly 121 may further include support members 121*d*, and the support members 121*d* may serve to support the blades 121*c*, respectively. The support member 121*d* may be erected adjacent to the rear side R' of the blade 121*c* in the rotating direction of the rotating rod 121*a*, so as to support the blade 121*c* during rotation of the brush assembly 121.

In some cases, each of the support members 121*d*, similar to the brush portion 121*b*, may be provided with a plurality of bristles 121*bb* arranged in the radial direction of the rotating rod 121*a*. That is, the blade 121*c* may be positioned between the plurality of bristles 121*bb* that are arranged on both left and right ends of the rotating rod 121*a*.

When the support member 121*d* is reinforced on the rear side of the blade 121*c*, the blade 121*c* may be restricted from being lowered in height due to being pressed down on the floor when the brush assembly 121 is rotated. This may result in more reducing possibility that hair is tangled in the brush portion 121*b*.

Particularly, when the support member 121*d* is provided with the plurality of bristles 121*bb* like the brush portion 121*b*, an addition of a separate member or process can be minimized. In this case, since the support member 121*d*, similar to the brush portion 121*b*, has a greater elastic modulus than the blade 121*c*, the support member 121*d* can sufficiently play the role of supporting the blade 121*c* at the rear.

On the other hand, the support member 121*d* disposed at the rear of the blade 121*c* may serve to support the blade 121 even if its height is not necessarily the same as that of the blade 121*c*. However, another embodiment may be implemented in which the support member 121*d* as well as the brush portion 121*b* is configured by the plurality of bristles 121*bb*, and as illustrated in FIG. 4B, may protrude by the same height h as the brush portion 121*b* and the blade 121*c*.

In this embodiment, hair can be restricted or prevented from being caught in the brush assembly 121 even if the rotating rod 121*a* is rotated toward one of the front side F' or the rear side R'. That is, the support member 121*d* and the brush portion 121*b* perform a brush function and a support function, respectively. This may be effective particularly in a general vacuum cleaner when the brush assembly 121 is frictionally rolled by the user's manipulation alternately to the front side F and the rear side R on the floor.

Figure 5A:
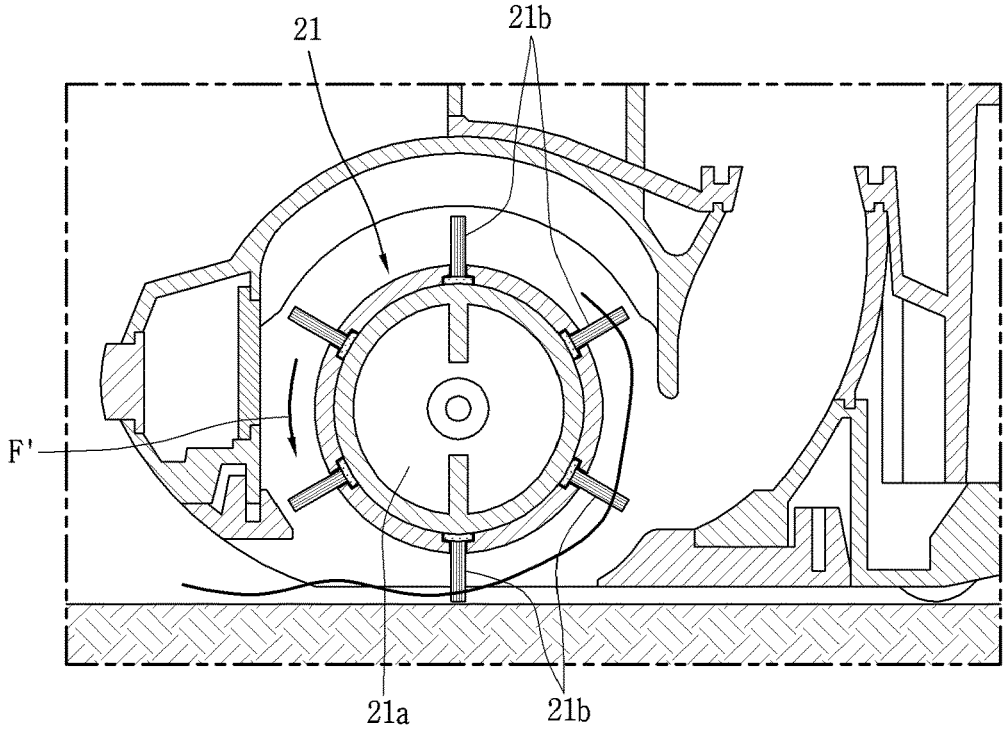
FIG. 5A is a conceptual view illustrating a state in which a hair gets tangled around a brush assembly without blades.
Figure 5B:
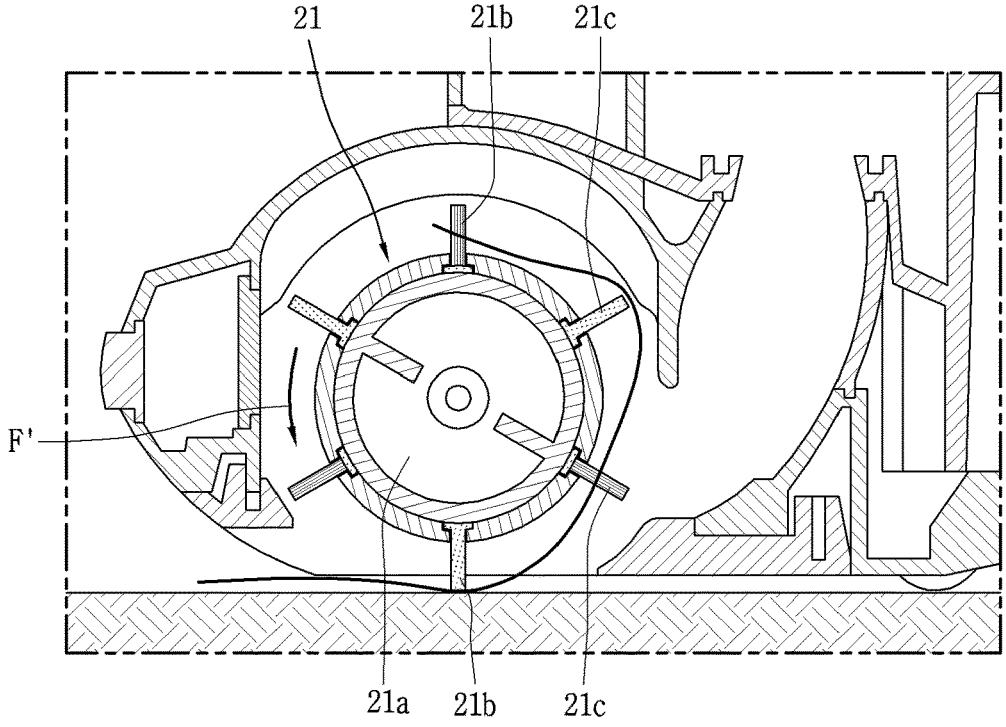
FIG. 5B is a conceptual view illustrating a state in which a hair gets tangled around a brush assembly having blades disposed apart from brush portions.
Figure 5C:
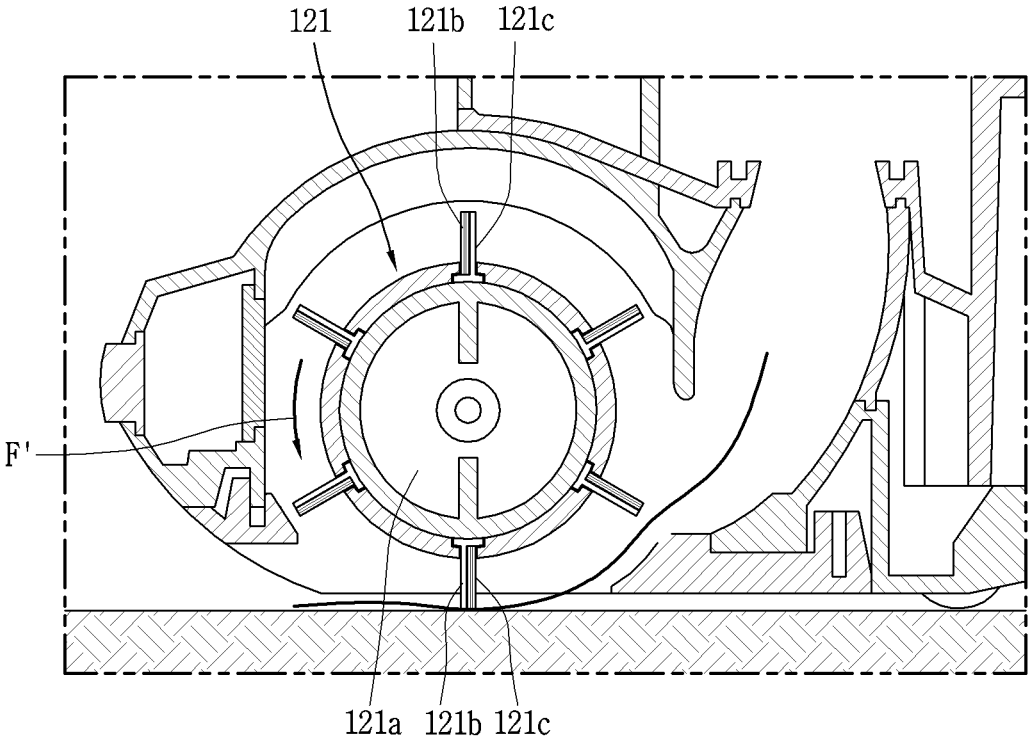
FIG. 5C is a conceptual view illustrating a state in which a hair is sucked when a brush assembly according to one embodiment of the present invention is mounted.

FIGS. 5A to 5C are conceptual views for comparing effects by the brush assembly 121 according to one embodiment of the present invention. FIG. 5A is a conceptual view illustrating a state in which hair is tangled around a brush assembly 21 without a blade. In a robot cleaner as one embodiment of the present invention, if blades are not provided, hair is consecutively introduced into the brush portions spaced apart from one another along the circumferential direction of the rotating rod 21*a*, so as to be tangled (wound, twisted) around the brush assembly 21.

FIG. 5B is a conceptual view illustrating a state in which a hair is tangled around a brush assembly 21 having blades 21*c* disposed apart from the brush portions 21*b*. Even if the blade 21*c* is mounted on the rotating rod 21*a*, the hair may still be introduced into a predetermined portion of an upper end of the brush portion 21*b* because the rotating rod 21*a* has a predetermined radius of curvature. In such a case, it is difficult to prevent the hair from getting tangled during the operation of the cleaner, although the removal of the hair after operation of the cleaner may be somewhat facilitated.

FIG. 5C is a conceptual view illustrating a state in which a hair is sucked when the brush assembly 121 according to the one embodiment of the present invention is mounted.

The blade 121*c* is disposed adjacent to the brush portion 121*b* so as to be in contact with the brush portion 121*b* when the brush assembly 121 rotates. In this case, the hair may be prevented from being tangled in each brush portion 121*b* arranged in the circumferential direction of the rotating rod 121*a*, or may be separated by the suction force of the suction unit 120 even if the hair is finely introduced into the upper end portion. This may also result in preventing the hair from remaining in the tangled state within the brush assembly 121 after cleaning.

The structure of the brush assembly for preventing foreign substances such as hair and the like from being introduced and remaining in the brush assembly has been described. Hereinafter, a structure of facilitating a fabrication of the brush assembly will be described according to different embodiments for convenience of understanding.

Figure 6:
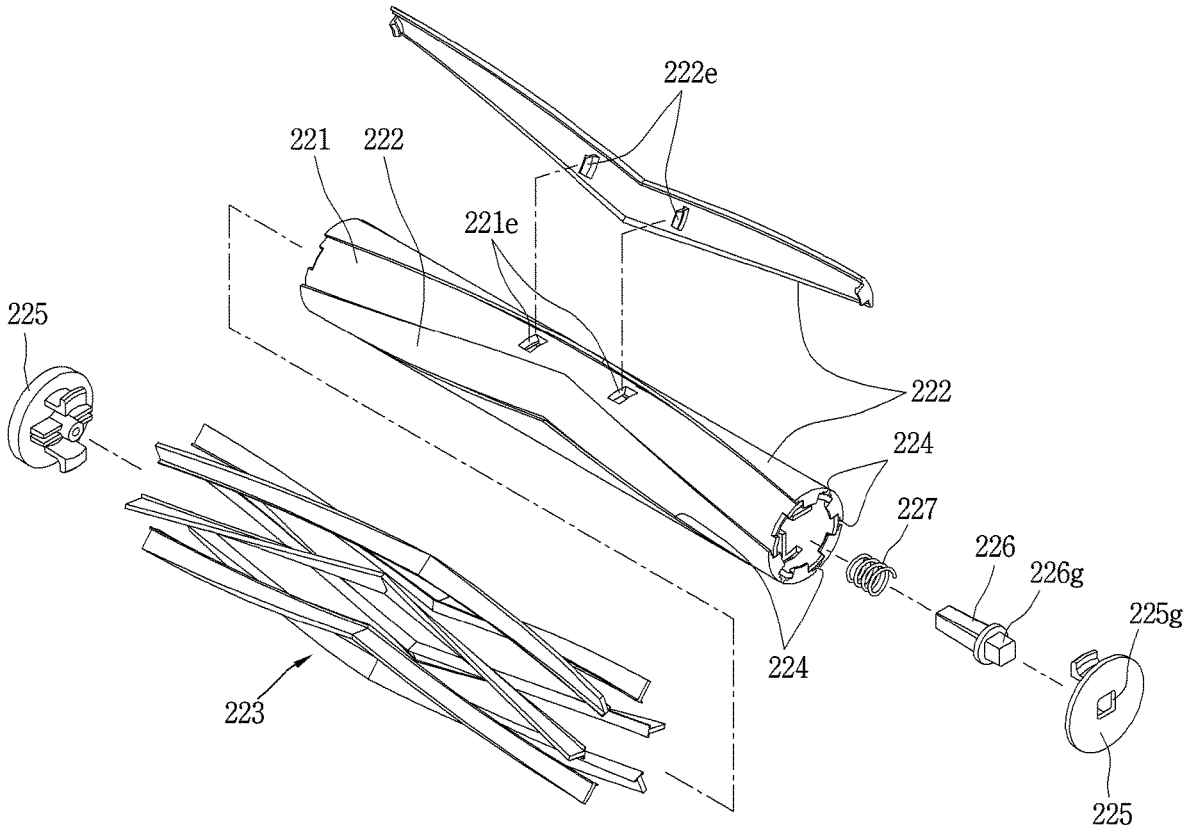
FIG. 6 is an exploded perspective view of components of the brush assembly illustrated in FIG. 3 in accordance with another embodiment of the present invention.

FIG. 6 is an exploded perspective view illustrating components of a brush assembly 220 illustrated in FIG. 3 in accordance with another embodiment of the present invention. Referring to FIG. 6, a brush assembly 220 according to another embodiment of the present invention includes a rotating rod 221, covers 222, and brush units 223.

Similar to the foregoing embodiment, the rotating rod 221 may be formed in a cylindrical shape extending long to both left and right sides with respect to the front side F to which the cleaner is moved, and may be rotatably accommodated in a rotation unit.

The cover 222 is a component mounted on an outer circumferential surface of the rotating rod 221, and is provided in plurality to form brush slits 224. As illustrated in FIG. 6, the plurality of covers 222 are arranged with being spaced apart from each other in a circumferential direction of the rotating rod 221, and a space between the neighboring covers 222 becomes the brush slit 224. The cover 222 may have a shape that substantially extends from one end to another end of the rotating rod 221. The plurality of covers 222 may be arranged in parallel with being spaced apart from one another in the circumferential direction. Accordingly, the brush slit 224 may be a long and narrow space connected from the one end to the another end of the rotating rod 221. The brush slit 224 may have a shape in which one or a plurality of spirals are connected along the outer circumferential surface of the rotating rod 221.

Figure 7:
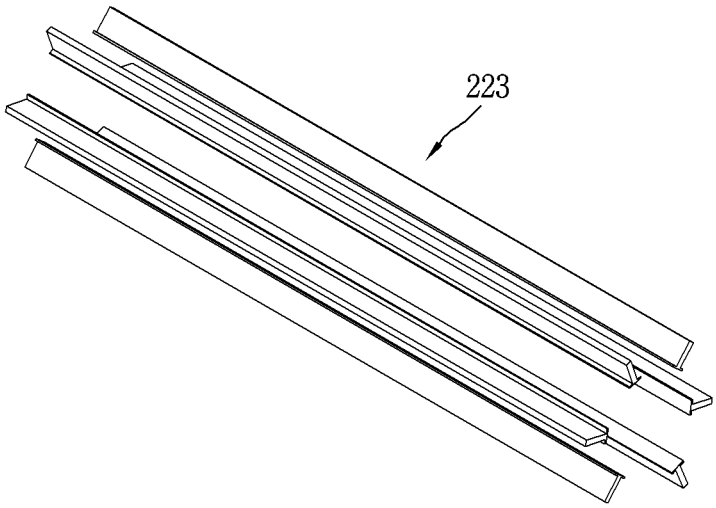
FIG. 7 is a sectional schematic view of a brush portion illustrated in FIG. 6 in a direction that it is coupled to a rotating rod.

FIG. 7 is a schematic sectional view illustrating the brush unit 223 illustrated in FIG. 6 in a direction in which the brush unit 223 is inserted into the rotating rod 221. Each of the brush units 223 of the present embodiment includes the brush portion 121*b* of the foregoing embodiment, and serves to sweep foreign substances such as dust and the like on the floor to be sucked into the cleaner. However, the brush unit 223 of this embodiment is formed to be inserted into the brush slit 224 from an end portion of the rotating rod 221.

To have the insertable structure, the brush unit 223 is provided with a base portion 223*a* and a brush portion 223*b*. The base portion 223*a* extends along the brush slit 224, and is formed to be inserted between the cover 222 and the outer circumferential surface of the rotating rod 221. As illustrated in FIG. 7, the base portion 223*a* is formed to extend to the front side F' and the rear side R' in the rotating direction of the rotating rod 221, so as to be inserted into an inner circumferential surface of the cover 222 at the front side F' and the rear side R'. The base portion 223*a* may extend in an axial direction of the rotating rod 221 by a length corresponding to a path of the brush slit 224.

The brush portion 223*b* may be mounted on the base portion 223*a*, and formed in a direction protruding to the outer circumferential surface of the rotating rod 221 through the brush slit 224. That is, the brush portion 223*b* may be provided with a plurality of bristles which are directed in the radial direction of the rotating rod 221 and arranged in parallel along the brush slit 224.

The brush assembly 220 according to the other embodiment of the present invention may be assembled in sequence of mounting the plurality of covers 222 on the rotating rod 221 and inserting the brush units 223 into one end portion of the rotating rod 221 in the axial direction of the rotating rod 221. With this coupling structure, the plurality of brush units 223 can be easily formed and the brush units 223 can be formed on the outer circumferential surface of the rotating rod 221 even in a complicated spiral shape.

Further, the brush unit 223 including the base portion 223*a* and the brush portion 223*b* may be separately fabricated. Accordingly, a plurality of bristles can be mounted on the flat base portion 223*a* at once without being individually planted in the outer circumferential surface of the rotation shaft 221. This may result in reducing time and costs required for mounting the bristles with more dense and uniform intervals.

In the meantime, the brush unit 223 of this embodiment may further include a blade 223*c* similar to that in the foregoing embodiment. The blade 223*c* may be disposed at the rear side R' that is an opposite direction of the rotating direction corresponding to the front side F' so as to be brought into contact with the brush portion 223*b* during the rotation of the brush assembly 220. The blade 223*c* can prevent an introduction of hair and the like into the brush portion 223*b*, as illustrated in the foregoing embodiment.

In addition, in this embodiment, by further providing the blade 223*c*, an effect of further providing on the base portion 223*a* an adhesion surface on which the brush portion 223*b* can be fixed is obtained. That is, as the additional adhesion surfaces are provided by the blades 223*c* in the radial direction of the rotating rod 221, the brush portions 223*b* with dense and uniform intervals can be firmly provided.

Also, similar to the foregoing embodiment, the brush unit 223 may be further provided with a support member 223*d* to support the blade 223*c*. In addition, the support member 223*d* and the brush portion 223*b* may also be made of the same material so as to perform the same function.

Particularly, in this embodiment, the support member 223*d* and the brush portion 223*b* may be integrally formed with each other, and or may be connected to cover an end portion of the base portion 223*a* of the blade 223*c*. As illustrated in FIG. 7, the plurality of bristles extending in a U-shape in the radial direction of the rotating rod 221 may surround the blade 223*c*, and the surrounded end portion may be pressed to be coupled to the base portion 223*a*. This may allow the brush unit 223 to be formed at once.

Meanwhile, the brush assembly 220 according to another embodiment of the present invention may additionally require a process of assembling the rotating rod 221 and the cover 222 by the addition of the plurality of covers 222. For convenience of this assembling process, a hook coupling manner may be applied.

Specifically, as illustrated in FIG. 6, the cover 222 may be provided with a hook portion (or hook) 222*e*, and the rotating rod 221 may be provided with a hook receiving portion (or recess) 221*e*. The hook portion 222*e* may protrude from an inner circumferential surface of the cover 222 toward the rotating rod 221 and may be provided with a hook surface facing the inner circumferential surface of the cover 222 at an end thereof. The hook receiving portion 221*e* may be formed on an outer circumferential surface of the rotating rod 221 so that the hook portion 222*e* is inserted therein and a hook surface may be locked to prevent separation of the cover 222.

The hook portion 222*e* and the hook receiving portion 221*e* may facilitate the assembling process of the brush assembly 220 without a coupling member such as a separate screw or the like.

In addition, an end cover 225 may be provided on at least one end portion of the rotating rod 221 to firmly seal and couple the brush assembly 220. As illustrated in FIG. 6, the end cover 225 may be formed in a circular shape so as to cover the end portion of the rotating rod 221, and cover end portions of the plurality of covers 222 at once. In particular, the end cover 225 may support the previously-inserted brush units 223 in the axial direction of the rotating rod 221 so as to prevent the brush units 223 from being separated from the brush slits 224.

The brush assembly 220 may further include a connection pin 226 as illustrated in FIG. 6. The connection pin 226 may be elastically supported by the elastic member 227 toward the inside of the rotating rod 221, and protrude in the axial direction of the rotating rod 221 through a through hole 225*g* which is formed through the end cover 225. At this time, the connection pin 226 may be provided with a locking portion 226*g* which is engaged with an inner surface of the end cover 225, and may be positioned so as not to be completely separated from the through hole 225*g* by use of an elastic member 227. The connection pin 226 may be pressed into the end cover 225 when the brush assembly 220 is mounted in the suction unit, and then protruded by elastic force when the brush assembly 220 is inserted into a proper position supported by the suction unit so as to be rotatably coupled.

Meanwhile, in this embodiment, each of the plurality of covers 222 may have a shape in which at least two spiral shapes are combined in the axial direction of the rotating rod 221. By the plurality of covers 222, the brush slit 224 may also extend into a shape of being bent at least once on the outer circumferential surface of the rotating rod 221.

Figure 8:
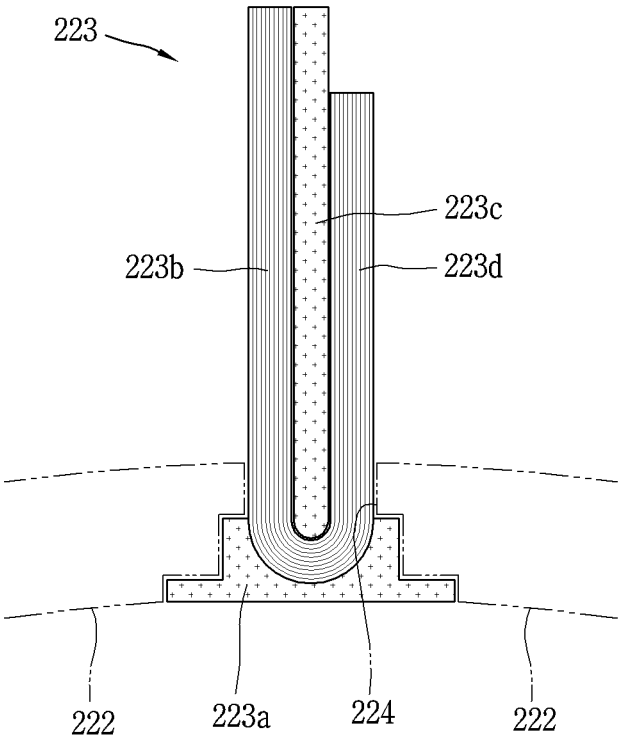
FIG. 8 is a perspective view illustrating a state in which the brush units illustrated in FIG. 6 are separately fabricated.

FIG. 8 is a perspective view illustrating a state in which the brush units 223 illustrated in FIG. 6 are separately fabricated. As illustrated in FIG. 8, the brush units 223 may be easily fabricated in a shape of extending in one direction during a separate fabricating process. The brush unit 223 may be made of an elastic material to be easily inserted into the brush slit 224 even when the brush slit 224 is not linearly formed.

That is, the base portion 223*a* and the brush portion 223*b* of the brush unit 223 are made of an elastic material. Accordingly, even when the brush unit 223 is inserted into the brush slit 224 which has a bent shape, the brush unit 223 may be inserted into the brush slit 224 with its shape deformed. Thus, the brush unit 223 does not have to separately be fabricated to correspond to various shapes, and can be fabricated according to a process by which bristles can be arranged densely. In addition, the brush assembly 220 may be formed in a shape having various brush arrangements as well as the shape of the brush assembly 220 illustrated in FIG. 6.

The foregoing embodiments are merely given of those embodiments for practicing a vacuum cleaner according to the present invention. Therefore, the present invention is not limited to the above-described embodiments, and it will be understood by those of ordinary skill in the art that various changes in form and details may be made therein without departing from the scope of the present invention.

What is claimed is:

1. A cleaner, comprising:
a cleaner main body; and
a suction head connected to the cleaner main body to suck air containing dust, and including a brush assembly,
wherein the brush assembly includes:
a rod configured to be rotatable;
a plurality of covers mounted on an outer circumferential surface of the rod, at least two of the covers being spaced apart from one another in a circumferential direction of the rod to form one or more brush slits each defined by adjacent sides of respective covers; and
one or more brush units inserted, respectively, into the brush slits from an end of the rod so as to be rotated together with the rod, and
wherein each of the brush units includes:
a base extending along a corresponding one of the brush slits and, in a state of the brush units being inserted into the brush slits, an outer end of the base being disposed between inwardly facing circumferential surfaces of two of the respective covers and the outer circumferential surface of the rod in a radial direction;
a brush having a bent portion inserted into the base and positioned inwardly of the outer end of the base in the radial direction; and
a blade positioned to press the bent portion of the brush toward the base.

2. The cleaner of claim 1, wherein the brush is inserted into the base to have a U shape with respect to the blade.

3. The cleaner of claim 2, wherein the brush includes a plurality of bristles arranged in the radial direction of the rod along the brush slit.

4. The cleaner of claim 3, wherein the brush is formed to have different respective lengths in a radial direction of the rod in a front and a rear of the blade.

5. The cleaner of claim 1, wherein, based on a rotational direction of the rod, the brush includes a first brush portion disposed in front of the blade and a second brush portion disposed rear of the blade.

6. The cleaner of claim 5, wherein the blade is positioned to support a rear of the first brush portion in the rotational direction of the rod.

7. The cleaner of claim 6, wherein the second brush portion is positioned to support a rear of the blade in the rotational direction of the rod.

8. The cleaner of claim 1, wherein the brush extends to cover an end of the blade facing the base.

9. The cleaner of claim 1, wherein the brush includes a plurality of bristles that extend to surround an end of the blade facing the base.

10. The cleaner of claim 9, wherein the end of the blade surrounded by the plurality of bristles is pressed into and coupled to the base.

11. The cleaner of claim 1, wherein the brush slit defines a narrow space that extends between ends of the rod.

12. The cleaner of claim 1, wherein the brush slit has a shape of one or more spirals that extend along the outer circumferential surface of the rod.

13. A cleaner, comprising:
a cleaner main body; and
a suction head connected to the cleaner main body to suck air containing dust, and including a brush assembly,
wherein the brush assembly includes:
a rod configured to rotate;
a plurality of covers mounted on an outer circumferential surface of the rod, at least two of the covers being spaced apart from one another in a circumferential direction of the rod to form one or more brush slits each defined by adjacent sides of respective covers; and one or more brush units insertable, respectively, into the brush slits from an end of the rod so as to be rotated together with the rod, and wherein each of the brush units includes:

a base extending along a corresponding one of the brush slits and, in a state of the brush units being inserted into the brush slits, an outer end of the base being disposed between an outer inwardly facing circumferential surfaces of two of the respective covers and the outer circumferential surface of the rod;

a brush extending towards the outer circumferential surface of the rod such that a portion of the brush is positioned inwardly of the outer end of the base;

a blade is positioned to support a rear side of the brush in a rotational direction of the rod; and a support member positioned to support a rear side of the blade in the rotational direction of the rod.

14. The cleaner of claim 13, wherein the brush and the support member are integrally connected to cover an end of the blade facing the base.

15. The cleaner of claim 13, wherein the support member and the brush are integrally formed in a U-shape relative to a radial direction of the rod.

16. The cleaner of claim 14, wherein the blade is positioned between the support member and the brush.

17. The cleaner of claim 13, wherein the support member and the brush are formed of a same material.

18. The cleaner of claim 13, wherein the support member and the brush are formed of a plurality of bristles that extend to surround an end of the blade facing the base.

19. The cleaner of claim 18, wherein the end of the blade surrounded by the plurality of bristles is pressed into and coupled to the base.

20. The cleaner of claim 13, wherein the blade is erected at a rear of the brush and positioned adjacent to the brush, so as to contact the brush during a rotation of the rod.

21. The cleaner of claim 13, wherein a width of a lower surface of the base facing the outer circumferential surface of the rod is greater than a width of an upper surface of the base receiving the brush, the blade, and the support member, and a width of the brush slits at an outer circumferential surface of the covers.

* * * * *